US007195864B2

(12) United States Patent
Yanagi et al.

(10) Patent No.: US 7,195,864 B2
(45) Date of Patent: Mar. 27, 2007

(54) SILVER HALIDE PHOTOGRAPHIC LIGHT-SENSITIVE MATERIAL AND AQUEOUS COATING COMPOSITION

(75) Inventors: Terukazu Yanagi, Minami-ashigara (JP); Katsuhiko Kanazawa, Fujinomiya (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 11/017,971

(22) Filed: Dec. 22, 2004

(65) Prior Publication Data

US 2005/0142505 A1 Jun. 30, 2005

(30) Foreign Application Priority Data

Dec. 26, 2003 (JP) ..... 2003-435458

(51) Int. Cl.

| | |
|---|---|
| ***G03C 1/85*** | (2006.01) |
| ***G03C 1/005*** | (2006.01) |
| ***G03C 1/494*** | (2006.01) |
| ***G03C 1/08*** | (2006.01) |
| ***G03C 7/26*** | (2006.01) |

(52) U.S. Cl. ..... 430/527; 430/546; 430/631

(58) Field of Classification Search ..... 430/527, 430/546, 631

See application file for complete search history.

(56) References Cited

U.S. PATENT DOCUMENTS 6,482,580 B2 11/2002 Morita

2003/0211430 A1* 11/2003 Ikeda et al. ..... 430/523

FOREIGN PATENT DOCUMENTS

| | | | |
|---|---|---|---|
| JP | 2001-233956 | * | 8/2001 |
| JP | 2002-116520 | A | 4/2002 |
| WO | WO-02/092719 | A1 | 11/2002 |

* cited by examiner

*Primary Examiner*—Geraldina Visconti
(74) *Attorney, Agent, or Firm*—Birch, Stewart, Kolasch & Birch, LLP

(57) ABSTRACT

A silver halide photographic light-sensitive material and an aqueous coating composition, each containing at least one compound represented by formula (1):

Formula (1)

in which, in formula (1), $A^1$ and $A^2$ each independently represent a hydrogen atom or a fluorine atom, x and y each independently represent an integer of from 1 to 6, $L^1$ and $L^2$ each independently represent —$CH_2$— or —$CH_2OCH_2$—, z represents the number of from 1 to 60, $R^1$ and $R^2$ each independently represent a hydrogen atom or a substituent, and $R^3$, $R^4$, $R^5$ and $R^6$ each independently represent a hydrogen atom, a methyl group or a hydroxymethyl group.

10 Claims, No Drawings

SILVER HALIDE PHOTOGRAPHIC LIGHT-SENSITIVE MATERIAL AND AQUEOUS COATING COMPOSITION

This application claims priority under 37 C.F.R. §119 of Japanese application no. 2003-435458, filed in Japan on Dec. 26, 2003, the entire contents of which are hereby incorporated by reference.

FIELD OF THE INVENTION

The present invention relates to a novel fluorine-containing surfactant, a silver halide photographic light-sensitive material excellent in static resistance and anti-static property, and an aqueous coating composition.

BACKGROUND OF THE INVENTION

Surfactants having fluorinated alkyl chains (hereinafter referred to as "fluorine-containing surfactant") can effect various surface modifications due to the peculiar properties (water repellency, oil repellency, lubricity, antistatic property, etc.) of the fluorinated alkyl chains, and are hence employed in the surface treatment of a wide variety of base materials, such as fibers, cloth, carpets and resins. Further, when a fluorine-containing surfactant is added to an aqueous medium solution of substrate of varied type, not only can a uniform coating film free from crawling be formed at the time of coating film formation but also an adsorption layer of surfactant can be formed on the surface of the substrate, to thereby cause the surface of coating film to have the above peculiar properties of fluorinated alkyl chains.

Also in photographic light-sensitive materials, various surfactants are used and play important roles. Photographic light-sensitive materials are usually produced by separately coating a plurality of coating solutions including an aqueous solution of a hydrophilic colloid binder (e.g., gelatin) on a support, to form multiple layers. Multiple hydrophilic colloid layers are often simultaneously coated as stacked layers. These layers include antistatic layer, undercoat layer, anti-halation layer, silver halide emulsion layer, intermediate layer, filter layer, protective layer and so forth, and various materials for exerting functions of the layers are added to the layers. Further, polymer latex may also be added to the hydrophilic colloid layer in some cases in order to improve physical properties of film. Furthermore, in order to add functional compounds hardly soluble in water, such as color-forming couplers, ultraviolet absorbers, fluorescent whitening agents and lubricants, to the hydrophilic colloid layer, these materials are sometimes emulsion-dispersed in a hydrophilic colloid solution as they are or as a solution in a high boiling point organic solvent, such as phosphoric acid ester-series compounds and phthalic acid ester compounds, for the preparation of a coating solution. As described above, photographic light-sensitive materials are generally constituted by various hydrophilic colloid layers, and in the production of them, it is required to uniformly coat coating solutions containing various materials at a high speed without defects such as repelling and uneven coating. In order to meet such requirements, a surfactant is often added to a coating solution as a coating aid.

Meanwhile, photographic light-sensitive materials are brought into contact with various materials during production, light exposure, and development thereof. For example, when a light-sensitive material is in a rolled shape in process steps, a back layer formed on the back surface of the support may contact with the surface layer. Further, when it is transported during process steps, it may contact with stainless steel rollers, rubber rollers, and the like. When they are brought into contact with these materials, surfaces (e.g. gelatin layer) of the light-sensitive materials are easily charged positively, and they may cause unnecessary discharge under certain circumstances. Therefore, there may remain undesirable traces of light exposure (called static marks) on the light-sensitive materials. Examples of methods of reducing this electrification property of gelatin include the prevention of the electrification (reducing an amount of electrification charged), making the accumulated charges leak easily, and the like. In order to prevent the electrification, a compound containing a fluorine atom is effective, and a specific fluorine-containing surfactant is often added.

In addition, reduction in surface resistance of a light-sensitive material by addition of a surfactant containing polyethylene (alkylene) oxide is frequently adopted as a method to achieve easy leakage of accumulated charges. More specifically, nonionic surfactants, containing both a fluorine atom and polyalkylene oxide in one molecule, are known (see, for example, in JP-A-2002-116520 ("JP-A" means unexamined published Japanese patent application)). Depending on the media to which such a method is applied, however, those surfactants cannot always produce sufficient effects. Therefore, further improvement has been needed.

On the other hand, it has been suggested that surfactants derived from perfluorooctanesulfonic acid prepared by electrolytic fluorination (as disclosed, e.g., in WO 02/092719), which have so far been used for general purposes, have a strong tendency to accumulate in ecosystems and raise safety concerns. As such, there is a need to develop fluorine-containing surfactants reduced in environmental load.

SUMMARY OF THE INVENTION

The present invention resides in a silver halide photographic light-sensitive material and an aqueous coating composition, each having at least one compound represented by formula (1):

Formula (1)

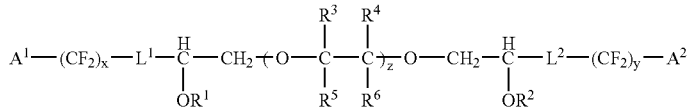

wherein, in formula (1), $A^1$ and $A^2$ each independently represent a hydrogen atom or a fluorine atom, x and y each independently represent an integer of from 1 to 6, $L^1$ and $L^2$ each independently represent —$CH_2$— or —$CH_2OCH_2$—, z represents the number of from 1 to 60, $R^1$ and $R^2$ each independently represent a hydrogen atom or a substituent, and $R^3$, $R^4$, $R^5$ and $R^6$ each independently represent a hydrogen atom, a methyl group or a hydroxymethyl group.

Other and further features and advantages of the invention will appear more fully from the following description.

DETAILED DESCRIPTION OF THE INVENTION

According to the present invention, there are provided the following means:

[1] A silver halide photographic light-sensitive material, comprising at least one compound represented by formula (1):

Formula (1)

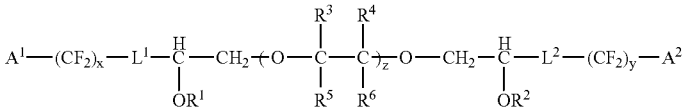

wherein, in formula (1), $A^1$ and $A^2$ each independently represent a hydrogen atom or a fluorine atom, x and y each independently represent an integer of from 1 to 6, $L^1$ and $L^2$ each independently represent —$CH_2$— or —$CH_2OCH_2$—, z represents the number of from 1 to 60, $R^1$ and $R^2$ each independently represent a hydrogen atom or a substituent, and $R^3$, $R^4$, $R^5$ and $R^6$ each independently represent a hydrogen atom, a methyl group or a hydroxymethyl group;

[2] The silver halide photographic light-sensitive material as described in the above item [1], wherein the compound represented by formula (1) is a compound represented by formula (1-A):

Formula (1-A)

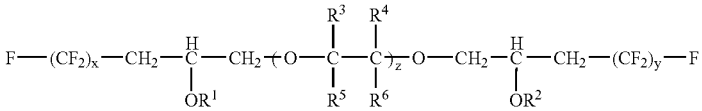

wherein, in formula (1-A), x, y, z, $R^1$, $R^2$, $R^3$, $R^4$, $R^5$, and $R^6$ have the same meanings as those in formula (1), respectively;

[3] The silver halide photographic light-sensitive material as described in the above item [1], wherein the compound represented by formula (1) is a compound represented by formula (1-B):

Formula (1-B)

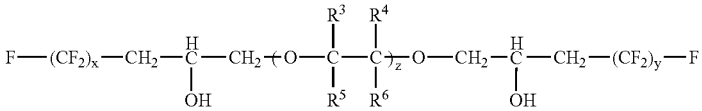

wherein, in formula (1-B), x, y, z, $R^3$, $R^4$, $R^5$ and $R^6$ have the same meanings as those in formula (1), respectively;

[4] The silver halide photographic light-sensitive material as described in any one of the above items [1] to [3], comprising at least one of the compounds represented by formulas (1), (1-A) and (1-B), and at least one compound represented by formula (2):

Formula (2)

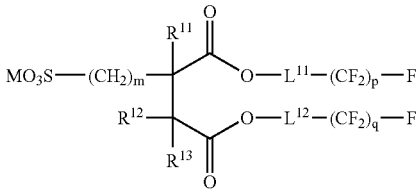

wherein, in formula (2), $R^{11}$, $R^{12}$ and $R^{13}$ each independently represent a hydrogen atom or a substituent; p and q each independently represent an integer of from 4 to 8; $L^{11}$ and $L^{12}$ each independently represent a substituted or unsubstituted alkylene group, a substituted or unsubstituted alkyleneoxy group, or a divalent linking group formed by combining these groups; m represents 0 or 1; and M represents a cation;

[5] The silver halide photographic light-sensitive material as described in the above item [4], wherein the compound represented by formula (2) is a compound represented by formula (2-A):

Formula (2-A)

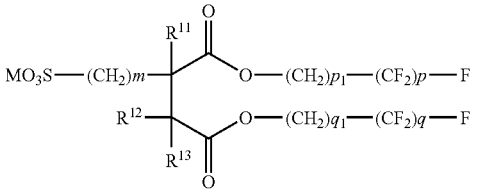

wherein, in formula (2-A), $R^{11}$, $R^{12}$, $R^{13}$, p, q, m and M have the same meanings as those in formula (2), respectively; and p1 and q1 each independently represent an integer of from 1 to 6;

[6] The silver halide photographic light-sensitive material as described in the above item [4], wherein the compound represented by formula (2) is a compound represented by formula (2-B):

Formula (2-B)

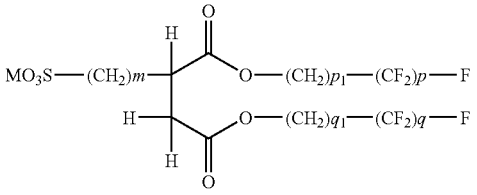

wherein, in formula (2-B), p, q, m and M have the same meanings as those in formula (2), respectively; and p1 and q1 each independently represent an integer of from 1 to 6;

[7] The silver halide photographic light-sensitive material as described in the above item [4], wherein the compound represented by formula (2) is a compound represented by formula (2-C):

Formula (2-C)

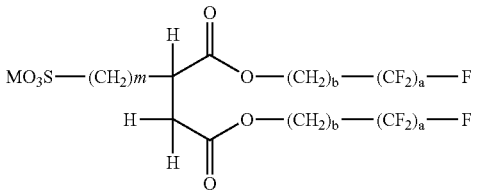

wherein, in formula (2-C), a represents an integer of from 4 to 6; b represents 2 or 3; m represents 0 or 1; and M has the same meaning as that in formula (2);

[8] The silver halide photographic light-sensitive material as described in any one of the above items [4] to [7], comprising at least one layer including a light-sensitive silver halide emulsion layer on a support, wherein a non-light-sensitive hydrophilic colloid layer is further included as an outermost layer, and wherein the outermost layer contains at least one of the compounds represented by formulas (1), (1-A) and (1-B), and at least one of the compounds represented by formulas (2), (2-A), (2-B) and (2-C);

[9] An aqueous coating composition, comprising at least one compound represented by formula (1):

Formula (1)

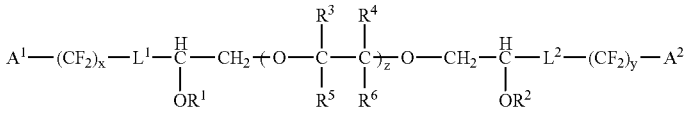

wherein, in formula (1), $A^1$ and $A^2$ each independently represent a hydrogen atom or a fluorine atom, x and y each independently represent an integer of from 1 to 6, $L^1$ and $L^2$ each independently represent $—CH_2—$ or $—CH_2OCH_2—$, z represents the number of from 1 to 60, $R^1$ and $R^2$ each independently represent a hydrogen atom or a substituent, and $R^3$, $R^4$, $R^5$ and $R^6$ each independently represent a hydrogen atom, a methyl group or a hydroxymethyl group;

[10] The aqueous coating composition as described in the above item [9], wherein the compound represented by formula (1) is a compound represented by formula (1-A):

Formula (1-A)

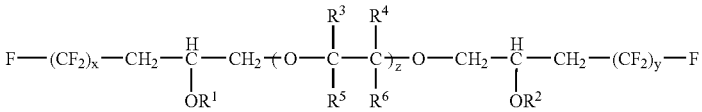

wherein, in formula (1-A), x, y, z, $R^1$, $R^2$, $R^3$, $R^4$, $R^5$, and $R^6$ have the same meanings as those in formula (1), respectively;

[11] The aqueous coating composition as described in the above item [9], wherein the compound represented by formula (1) is a compound represented by formula (1-B):

Formula (1-B)

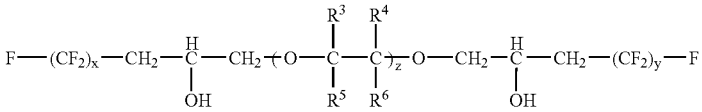

wherein, in formula (1-B), x, y, z, $R^3$, $R^4$, $R^5$ and $R^6$ have the same meanings as those in formula (1), respectively;

[12] The aqueous coating composition as described in any one of the above items [9] to [11], further comprising at least one compound represented by formula (2):

Formula (2)

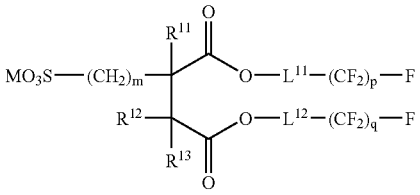

wherein, in formula (2), $R^{11}$, $R^{12}$ and $R^{13}$ each independently represent a hydrogen atom or a substituent; p and q each independently represent an integer of from 4 to 8; $L^{11}$ and $L^{12}$ each independently represent a substituted or unsubstituted alkylene group, a substituted or unsubstituted alkyleneoxy group, or a divalent linking group formed by combining these groups; m represents 0 or 1; and M represents a cation;

[13] The aqueous coating composition as described in the above item [12], wherein the compound represented by formula (2) is a compound represented by formula (2-A):

Formula (2-A)

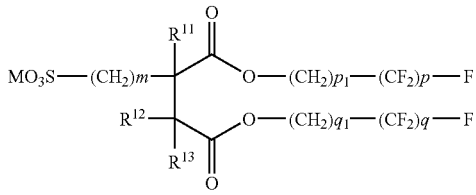

wherein, in formula (2-A), $R^{11}$, $R^{12}$, $R^{13}$, p, q, m and M have the same meanings as those in formula (2), respectively; and p1 and q1 each independently represent an integer of from 1 to 6;

[14] The aqueous coating composition as described in the above item [12], wherein the compound represented by formula (2) is a compound represented by formula (2-B):

Formula (2-B)

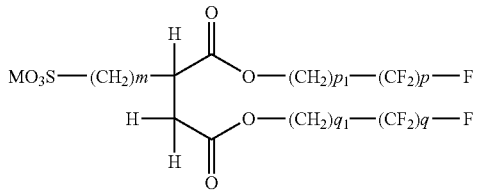

wherein, in formula (2-B), p, q, m and M have the same meanings as those in formula (2), respectively; and p1 and q1 each independently represent an integer of from 1 to 6;

[15] The aqueous coating composition as described in the above item [12], wherein the compound represented by formula (2) is a compound represented by formula (2-C):

Formula (2-C)

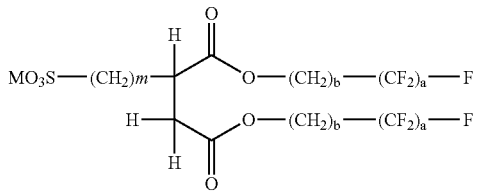

wherein, in formula (2-C), a represents an integer of from 4 to 6; b represents 2 or 3; m represents 0 or 1; and M has the same meaning as that in formula (2); and

[16] The aqueous coating composition as described in any one of the above items [9] to [15], comprising the compound represented by any one of formulas (1), (1-A) and (1-B) as a surfactant.

The present invention is described below in detail.

In the present specification, the word "to" placed between two numerical values is used in the sense of including these numerical values as lower and upper limits.

First, the compound represented by formula (1) used in the present invention is described below, in detail.

In formula (1), $A^1$ and $A^2$ each independently represent a hydrogen atom or a fluorine atom, x and y each independently represent an integer of from 1 to 6, $L^1$ and $L^2$ each independently represent —$CH_2$— or —$CH_2OCH_2$—, z represents the number of from 1 to 60 (herein z represents the number including a decimal, as well as an integer), $R^1$ and $R^2$ each independently represent a hydrogen atom or a substituent, and $R^3$, $R^4$, $R^5$ and $R^6$ each independently represent a hydrogen atom, a methyl group or a hydroxymethyl group.

In formula (1), it is preferable that both $A^1$ and $A^2$ are a fluorine atom. Each of $L^1$ and $L^2$ is preferably —$CH_2$— when $A^1$ and $A^2$ each are a fluorine atom, while it is preferably —$CH_2OCH_2$— when $A^1$ and $A^2$ each are a hydrogen atom.

Each of x and y is preferably 2, 4 or 6; more preferably 4 or 6; and further preferably 4.

With respect to the substituents represented by $R^1$ and $R^2$, the substituent T hereinafter defined is applicable. Each of $R^1$ and $R^2$ is preferably a hydrogen atom, an alkyl group having 1 to 20 carbon atoms, or an acyl group having 1 to 20 carbon atoms; more preferably a hydrogen atom, an alkyl group having 1 to 12 carbon atoms, or an acyl group having 1 to 16 carbon atoms; further preferably a hydrogen atom, an alkyl group having 1 to 8 carbon atoms, or an acyl group having 1 to 12 carbon atoms; and particularly preferably a hydrogen atom.

With respect to $R^3$, $R^4$, $R^5$ and $R^6$, it is preferable that three of them each are a hydrogen atom and the other one is a hydrogen atom, a methyl group, or a hydroxymethyl group; and more preferable that all of $R^3$, $R^4$, $R^5$ and $R^6$ each are a hydrogen atom.

z is preferably the number of from 5 to 50, more preferably from 10 to 50, further preferably from 15 to 45, and particularly preferably from 20 to 40. When z have a distribution, the value represented by z represents a mean value in the distribution.

Of the compounds represented by formula (1), compounds represented by formula (1-A) are preferred to the others.

Formula (1)

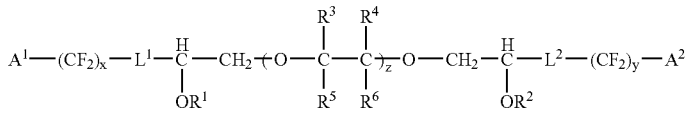

Formula (1-A)

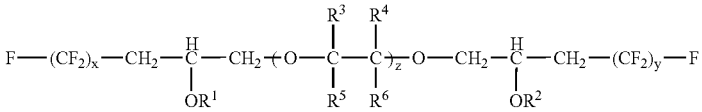

In formula (1-A), x, y, z, $R^1$, $R^2$, $R^3$, $R^4$, $R^5$ and $R^6$ have the same meanings as those in formula (1), respectively, and preferable ranges thereof are also the same.

Of the compounds represented by formula (1), compounds represented by formula (1-B) are further preferred over the others.

Formula (1-B)

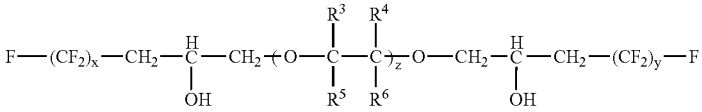

In formula (1-B), x, y, z, $R^3$, $R^4$, $R^5$ and $R^6$ have the same meanings as those in formula (1), respectively, and preferable ranges thereof are also the same.

Specific examples of the compound represented by formula (1) are illustrated below, but these examples should not be construed as limiting the scope of the present invention in any way.

In this connection, "PEO" stands for —$CH_2CH_2O$—, and "PPO" stands for —$CH_2CH(CH_3)O$— in the following examples.

FNS-1

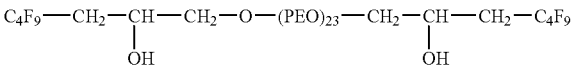

FNS-2

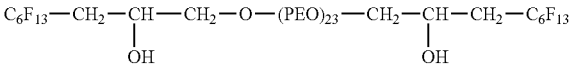

FNS-3

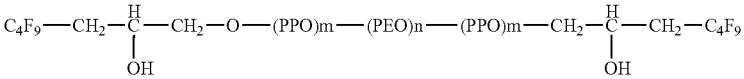

n = 26.3 m = 2.6

FNS-4

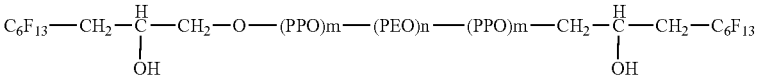

n = 26.3 m = 2.6

FNS-5

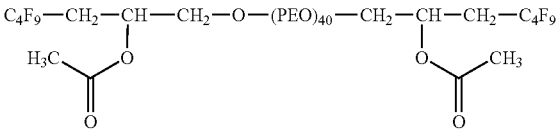

FNS-6

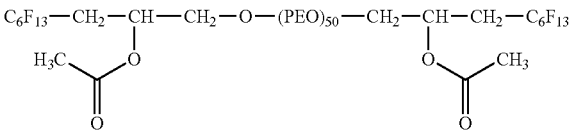

-continued

FNS-7

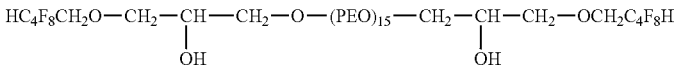

FNS-8

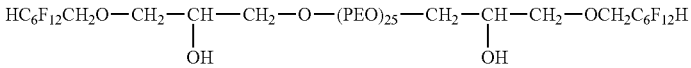

FNS-9

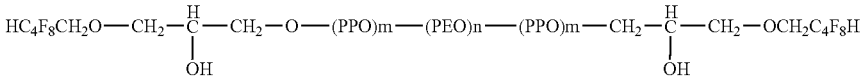

m = 15 n = 2

FNS-10

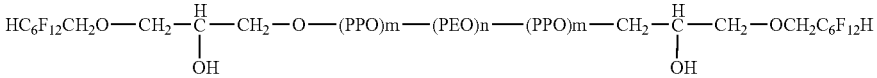

m = 20 n = 5

FNS-11

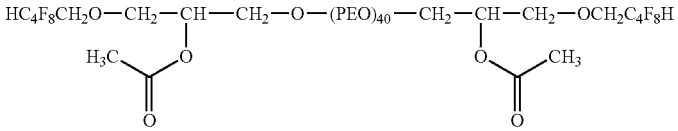

FNS-12

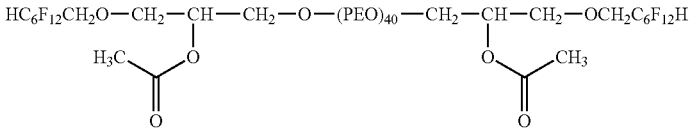

Synthesis examples of the compounds represented by formula (1) are described below in detail, but these examples should not be construed as placing any restrictions on the present invention.

[Synthesis of Exemplified Compound FNS-1]

To 8.00 g (8 mmol) of polyethylene oxide having a number average molecular weight of 1,000, were added 4.41 g (16 mmol) of 3-perfluorobutyl-1,2-epoxypropane produced by Daikin Fine Chemical Institute and about 25 μL (0.2 mmol) of $BF_3$-diethyl ether complex. The mixture was heated at 70° C. with stirring for 8 hours, and then cooled to room temperature, to yield 10.2 g of FNS-1 as a white waxy solid.

[Synthesis of Exemplified Compound FNS-2]

To 8.0 g (8.0 mmol) of polyethylene oxide having a number average molecular weight of 1,000, were added 6.0 g (16 mmol) of 3-perfluorohexyl-1,2-epoxypropane produced by Daikin Fine Chemical Institute and about 25 μL (0.2 mmol) of $BF_3$-diethyl ether complex. The mixture was heated at 70° C. with stirring for 8 hours, and then cooled to room temperature, to yield 14 g of FNS-2 as a white waxy solid.

[Synthesis of Exemplified Compound FNS-3]

To 7.25 g (5 mmol) of polyalkylene oxide having a number average molecular weight of 1,450, were added 2.76 g (10 mmol) of 3-perfluorobutyl-1,2-epoxypropane produced by Daikin Fine Chemical Institute and about 37 μL (0.3 mmol) of $BF_3$-diethyl ether complex. The mixture was heated at 70° C. with stirring for 8 hours, and then cooled to room temperature, to yield 9.1 g of FNS-3 as a white waxy solid.

[Synthesis of Exemplified Compound FNS-4]

To 7.25 g (5 mmol) of polyalkylene oxide having a number average molecular weight of 1,450, were added 3.76 g (10 mmol) of 3-perfluorohexyl-1,2-epoxypropane produced by Daikin Fine Chemical Institute and about 37 μL (0.3 mmol) of $BF_3$-diethyl ether complex. The mixture was heated at 70° C. with stirring for 8 hours, and then cooled to room temperature, to yield 9.5 g of FNS-4 as a white waxy solid.

In addition, FNS-5 and FNS-6 can be synthesized easily by reacting the hydroxyl groups of FNS-1 and FNS-2 with acid halide or the like.

Next, the compounds represented by formula (2) that can be used in the present invention are described in detail.

Formula (2)

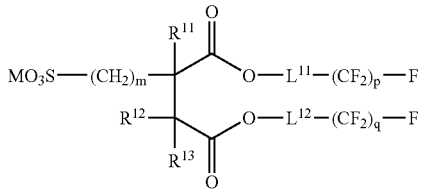

In formula (2), $R^{11}$, $R^{12}$ and $R^{13}$ independently represent a hydrogen atom or a substituent; p and q each independently represent an integer of from 4 to 8; $L^{11}$ and $L^{12}$ each independently represent a substituted or unsubstituted alkylene group, a substituted or unsubstituted alkyleneoxy group, or a divalent linking group formed by combining these groups; m represents 0 or 1; and M represents a cation.

In formula (2), with respect to the substituents represented by $R^{11}$, $R^{12}$ and $R^{13}$, the substituent T defined hereinafter is applicable.

Each of $R^{11}$, $R^{12}$ and $R^{13}$ is preferably an alkyl group or a hydrogen atom, more preferably an alkyl group having 1 to 12 carbon atoms or a hydrogen atom, further preferably a methyl group or a hydrogen atom, and particularly preferably a hydrogen atom.

It is preferable that p and q each are an integer of from 4 to 6, and that p=q; more preferable that p and q each are preferably an integer of 4 or 6, and that p=q; and further preferable p=q=4.

With respect to m, 0 and 1 are equally preferred.

$L^{11}$ and $L^{12}$ each independently represent a substituted or unsubstituted alkylene group, a substituted or unsubstituted alkyleneoxy group, or a divalent linkage group formed by combining these groups. With respect to the substituents on these groups, the substituent T defined hereinafter is applicable.

Each of $L^{11}$ and $L^{12}$ is preferably a group having 4 or less of carbon atoms, or an unsubstituted alkylene group.

Suitable examples of the cation represented by M include alkali metal ions (such as lithium ion, sodium ion and potassium ion), alkaline earth metal ions (such as barium ion and calcium ion) and ammonium ion. Of these ions, lithium ion, sodium ion, potassium ion and ammonium ion are preferred over the others.

Of the compounds represented by formula (2), compounds represented by formula (2-A) are preferred.

Formula (2-A)

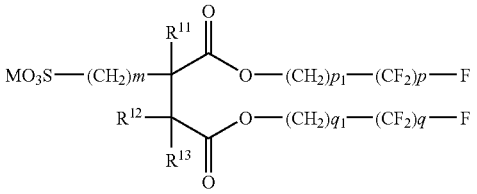

In formula (2-A), $R^{11}$, $R^{12}$, $R^{13}$, p, q, m and M have the same meanings as those in formula (2), respectively, and preferable ranges thereof are also the same. p1 and q1 each independently represent an integer of from 1 to 6.

In formula (2-A), it is preferable that p1 and q1 each are an integer of from 1 to 6, and that p1=q1; more preferable that p1 and q1 each are an integer of 2 or 3, and that p1=q1; and further preferable p1=q1=2.

Of the compounds represented by formula (2), compounds represented by formula (2-B) are more preferred.

Formula (2-B)

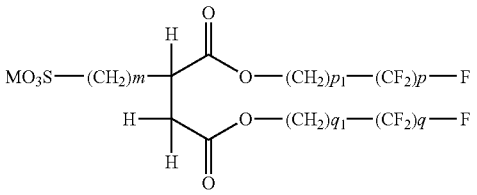

In formula (2-B), p, q, m and M have the same meanings as those in formula (2), respectively, and preferable ranges thereof are also the same. In formula (2-B), p1 and q1 have the same meanings as those in formula (2-A), respectively, and preferable ranges thereof are also the same.

Of the compounds represented by formula (2), compounds represented by formula (2-C) are further preferred.

Formula (2-C)

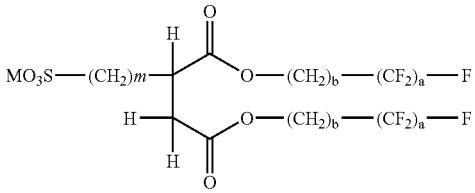

In formula (2-C), a represents an integer of from 4 to 6, preferably 4. b represents 2 or 3, preferably 2. m represents 0 or 1, and both are equally suitable. M has the same meaning as that in formula (2), and preferable range thereof is also the same.

Specific examples of the compound represented by formula (2) are illustrated below, but these examples should not be construed as limiting the scope of the present invention in any way.

FS-1

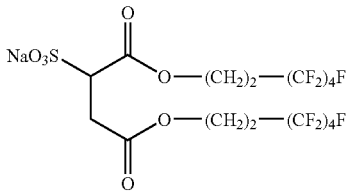

FS-2

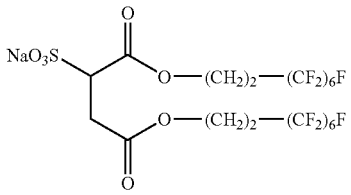

FS-3

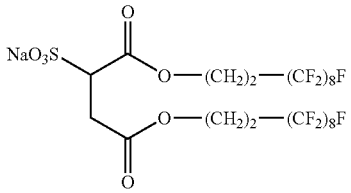

FS-4

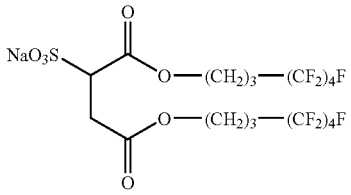

-continued
FS-5
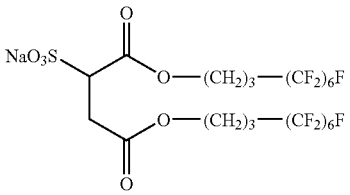
FS-6
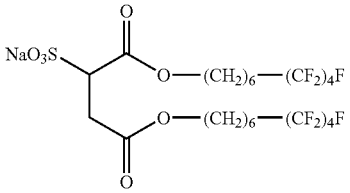
FS-7
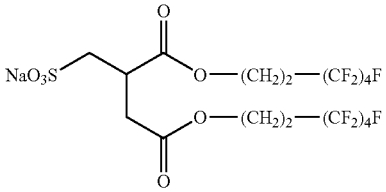
FS-8
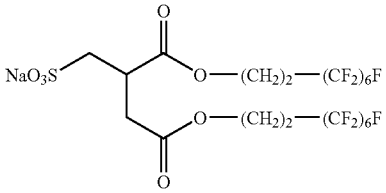
FS-9
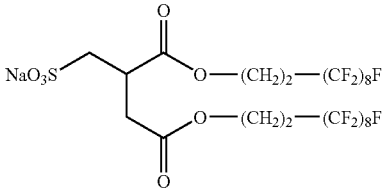
FS-10
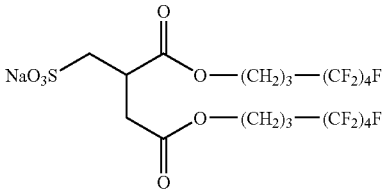
FS-11
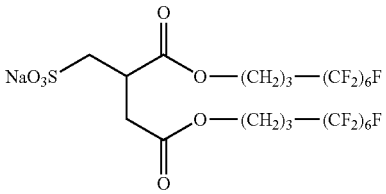
FS-12
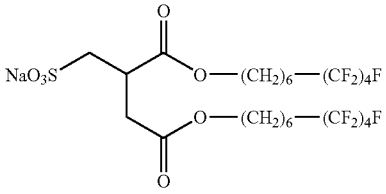
-continued
FS-13
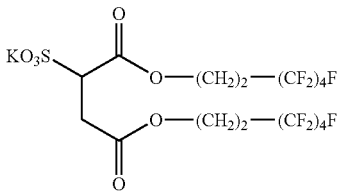
FS-14
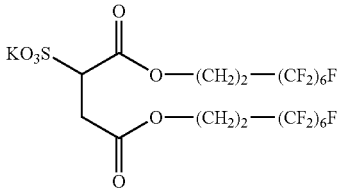
FS-15
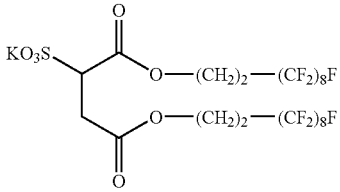
FS-16
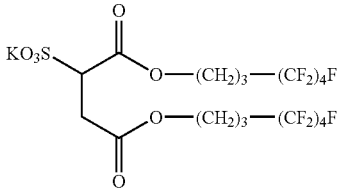
FS-17
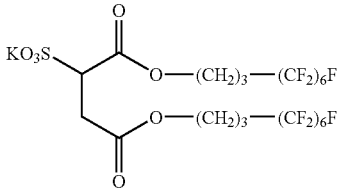
FS-18
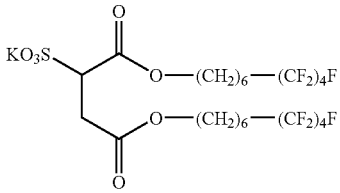
FS-19
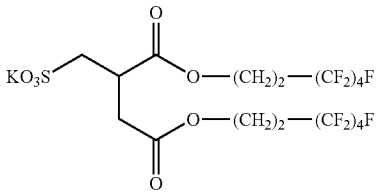
FS-20
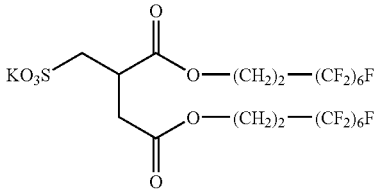

-continued
FS-21
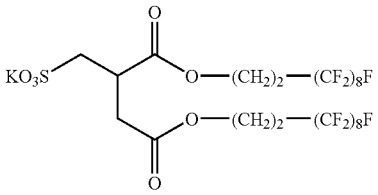
FS-22
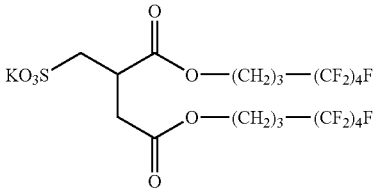
FS-23
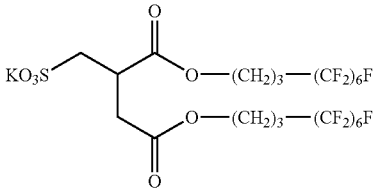
FS-24
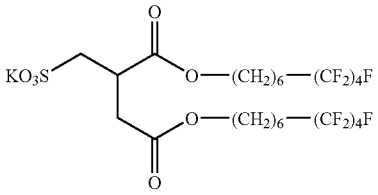
FS-25
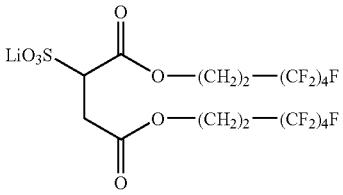
FS-26
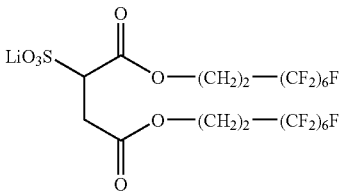
FS-27
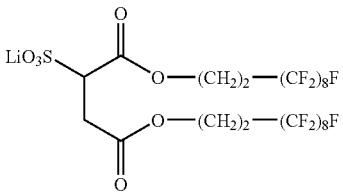
FS-28
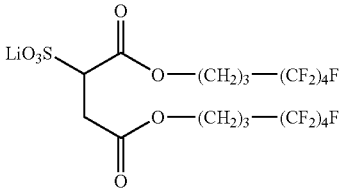
-continued
FS-29
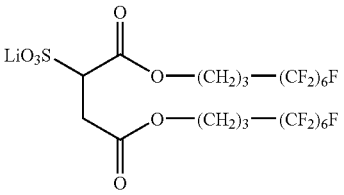
FS-30
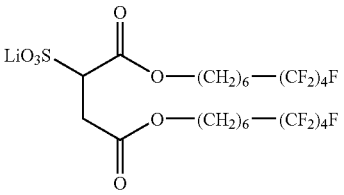
FS-31
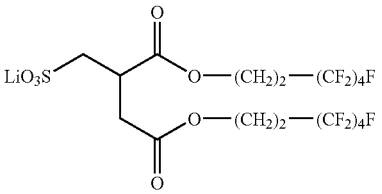
FS-32
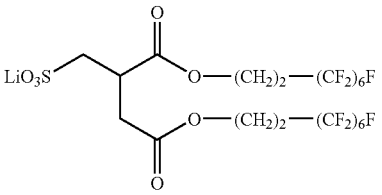
FS-33
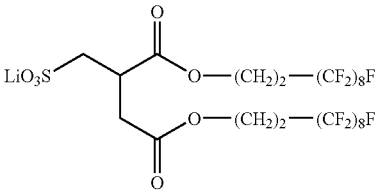
FS-34
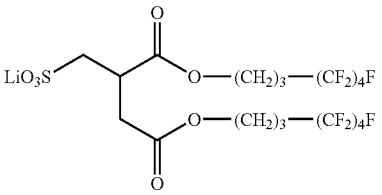
FS-35
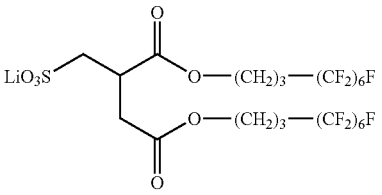
FS-36
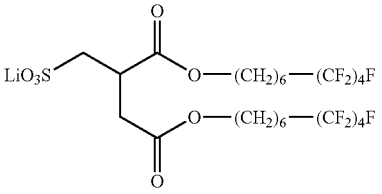

-continued

FS-37

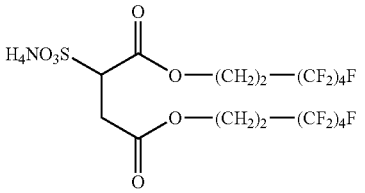

FS-38

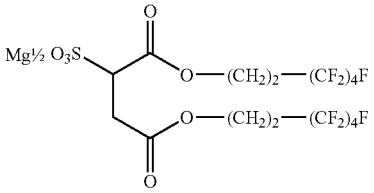

FS-39

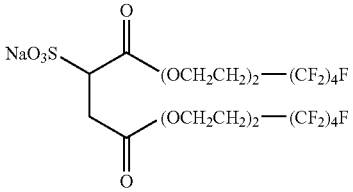

FS-40

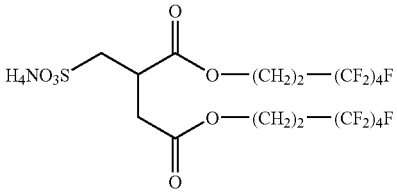

FS-41

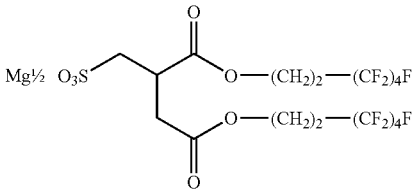

FS-42

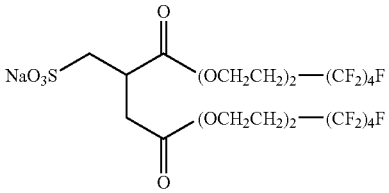

FS-43

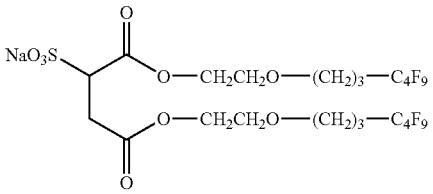

FS-44

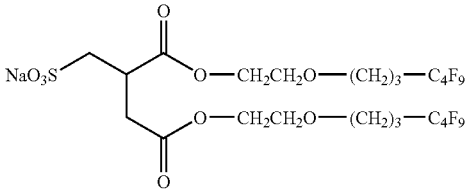

-continued

FS-45

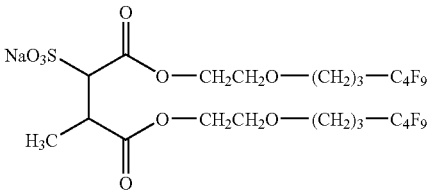

The compounds represented by formula (2) can be synthesized with ease in accordance with a method, for example, described in German Patent No. 2329660, U.S. Pat. No. 4,968,599 or JP-A-1-19137. The counter cation can be easily exchanged by use of an ion exchange resin.

Next, the substituent T is explained in more detail.

Examples of the substituent represented by T include alkyl groups (each having preferably 1 to 20 carbon atoms, more preferably 1 to 12 carbon atoms, and particularly preferably 1 to 8 carbon atoms, such as methyl, ethyl, iso-propyl, tert-butyl, n-octyl, n-decyl, n-hexadecyl, cyclopropyl, cyclopentyl, and cyclohexyl), alkenyl groups (each having preferably 2 to 20 carbon atoms, more preferably 2 to 12 carbon atoms, and particularly preferably 2 to 8 carbon atoms, such as vinyl, allyl, 2-butenyl, and 3-pentenyl), alkynyl groups (each having preferably 2 to 20 carbon atoms, more preferably 2 to 12 carbon atoms, and particularly preferably 2 to 8 carbon atoms, such as propargyl and 3-pentynyl), aryl groups (each having preferably 6 to 30 carbon atoms, more preferably 6 to 20 carbon atoms, and particularly preferably 6 to 12 carbon atoms, such as phenyl, p-methylphenyl, and naphthyl), substituted or unsubstituted amino groups (each having preferably 0 to 20 carbon atoms, more preferably 0 to 10 carbon atoms, and particularly preferably 0 to 6 carbon atoms, such as amino, and alkyl-substituted amino groups (e.g. methylamino, dimethylamino, diethylamino, and dibenzylamino)), alkoxyl groups (each having preferably 1 to 20 carbon atoms, more preferably 1 to 12 carbon atoms, and particularly preferably 1 to 8 carbon atoms, such as methoxy, ethoxy, and butoxy), aryloxy groups (each having preferably 6 to 20 carbon atoms, more preferably 6 to 16 carbon atoms, and particularly preferably 6 to 12 carbon atoms, such as phenyloxy and 2-naphtyloxy), acyl groups (each having preferably 1 to 20 carbon atoms, more preferably 1 to 16 carbon atoms, and particularly preferably 1 to 12 carbon atoms, such as acetyl, benzoyl, formyl, and pivaloyl), alkoxycarbonyl groups (each having preferably 2 to 20 carbon atoms, more preferably 2 to 16 carbon atoms, and particularly preferably 2 to 12 carbon atoms, such as methoxycarbonyl and ethoxycarbonyl), aryloxycarbonyl groups (each having preferably 7 to 20 carbon atoms, more preferably 7 to 16 carbon atoms, and particularly preferably 7 to 10 carbon atoms, such as phenyloxycarbonyl), acyloxy groups (each having preferably 2 to 20 carbon atoms, more preferably 2 to 16 carbon atoms, and particularly preferably 2 to 10 carbon atoms, such as acetoxy and benzoyloxy), acylamino groups (each having preferably 2 to 20 carbon atoms, more preferably 2 to 16 carbon atoms, and particularly preferably 2 to 10 carbon atoms, such as acetylamino and benzoylamino), alkoxycarbonylamino groups (each having preferably 2 to 20 carbon atoms, more preferably 2 to 16 carbon atoms, and particularly preferably 2 to 12 carbon atoms, such as methoxycarbonylamino), aryloxycarbonylamino groups (each having preferably 7 to 20 carbon atoms, more preferably 7 to 16 carbon atoms, and particularly preferably 7 to 12 carbon atoms, such as phenyloxycarbonylamino), sulfonylamino groups (each having preferably 1 to 20 carbon atoms, more preferably 1 to 16 carbon atoms, and particularly preferably 1 to 12 carbon atoms, such as methanesulfonylamino and benzenesulfonylamino), sulfamoyl groups (each having preferably 0 to 20 carbon atoms, more preferably 0 to 16 carbon atoms, and particularly preferably 0 to 12 carbon atoms, such as sulfamoyl, methylsulfamoyl, dimethylsulfamoyl, and phenylsulfamoyl), carbamoyl groups (each having preferably 1 to 20 carbon atoms, more preferably 1 to 16 carbon atoms, and particularly preferably 1 to 12 carbon atoms, such as carbamoyl, methylcarbamoyl, diethylcarbamoyl, and phenylcarbamoyl), alkylthio groups (each having preferably 1 to 20 carbon atoms, more preferably 1 to 16 carbon atoms, and particularly preferably 1 to 12 carbon atoms, such as methylthio and ethylthio), arylthio groups (each having preferably 6 to 20 carbon atoms, more preferably 6 to 16 carbon atoms, and particularly preferably 6 to 12 carbon atoms, such as phenylthio), sulfonyl groups (each having preferably 1 to 20 carbon atoms, more preferably 1 to 16 carbon atoms, and particularly preferably 1 to 12 carbon atoms, such as mesyl and tosyl), sulfinyl groups (each having preferably 1 to 20 carbon atoms, more preferably 1 to 16 carbon atoms, and particularly preferably 1 to 12 carbon atoms, such as methanesulfinyl and benzenesulfinyl), ureido groups (each having preferably 1 to 20 carbon atoms, more preferably 1 to 16 carbon atoms, and particularly preferably 1 to 12 carbon atoms, such as ureido, methylureido, and phenylureido), phosphoric acid amide groups (each having preferably 1 to 20 carbon atoms, more preferably 1 to 16 carbon atoms, and particularly preferably 1 to 12 carbon atoms, such as diethylphosphoric acid amide and phenylphosphoric acid amide), hydroxyl group, mercapto groups, halogen atoms (such as fluorine, chlorine, bromine, and iodine atoms), cyano group, sulfo group, carboxyl group, nitro group, hydroxamic acid groups, sulfino group, hydrazino group, imino group, heterocyclic groups (each having preferably 1 to 30 carbon atoms, and more preferably 1 to 12 carbon atoms, having heteroatoms such as nitrogen, oxygen, and sulfur atoms, and specifically including imidazolyl, pyridyl, quinolyl, furyl, piperidyl, morpholino, benzoxazolyl, benzimidazolyl and benzthiazolyl, these groups are preferably 5- to 6-membered rings), and silyl groups (each having preferably 3 to 40 carbon atoms, more preferably 3 to 30 carbon atoms, and particularly preferably 3 to 24 carbon atoms, such as trimethylsilyl and triphenylsilyl). These substituents may be further substituted. When there are two or more substituents, they may be the same or different. Further, they may be combined to form a ring if possible.

The compound represented by formula (1) or (2) that can be used in the present invention may be mixed with a medium capable of dissolving and/or dispersing the compound, or the like, and then added. Depending on purposes, the medium or the like may contain other ingredients as appropriate.

The weight ratio of the compound represented by formula (1) to the compound represented by formula (2) is preferably 10 or less, more preferably 7 or less, and particularly preferably 5 or less.

The medium used for dissolving or dispersing the compound represented by formula (1) or (2) according to the present invention is preferably an aqueous medium. The aqueous medium includes water, and a mixture of an organic solvent other than water (e.g., methanol, ethanol, isopropyl alcohol, n-butanol, methyl cellosolve, dimethylformamide, acetone, and the like) with water (the medium preferably contains 50 wt % or more of water). The aqueous medium is preferably water or a mixture of water and alcohol (e.g. methanol, ethanol, and isopropyl alcohol), more preferably water or a mixture of water and methanol, and particularly preferably water.

The concentration of the added compound represented by formula (1) or (2) that can be used in the present invention (the total concentration of both the compound represented by formula (1) and the compound represented by formula (2) when they are added in combination) in a solution and/or dispersion is preferably from 0.001 to 40 mass %, more preferably from 0.01 to 20 mass %, further preferably from 0.1 to 10 mass %, and particularly preferably from 1 to 10 mass %.

As for the compound represented by formula (1) or formula (2) that can be used in the present invention, a single kind of the compound may be used, or two or more kinds of the compounds may be used as a mixture. Further, the compound represented by formula (1) or (2) may be used together with other surfactants.

The surfactants that can be used together include various surfactants of anionic type, cationic type, and nonionic type. Moreover, the surfactants that can be used together may be polymer surfactants. The surfactants that can be used together may be fluorine-series surfactants or hydrocarbon-series surfactants, except for the surfactants that can be used in the present invention (e.g. the compound represented by formula (1) or (2)). The surfactants that can be used together are more preferably anionic surfactants or nonionic surfactants. The surfactants that can be used together include, for example, those disclosed in JP-A-62-215272 (pages 649–706), Research Disclosure (RD) Items 17643, pages 26–27 (December, 1978), 18716, page 650 (November, 1979) and 307105, pages 875–876 (November, 1989), and so forth.

The compound represented by formula (1) or (2) that can be used in the present invention have no particular restriction as into which constituent layer of a silver halide photographic light-sensitive material they are incorporated, and they can be used in the same layers as conventional surfactants have been used. The layer into which the compound is preferably incorporated is a surface protective layer, an outermost protective layer, and the like.

The amount of the compound represented by formula (1) or (2) that can be used in the present invention is not particularly limited, and it can be arbitrarily determined depending on structure or use of a compound to be used, types and amounts of materials contained in the aqueous composition, composition of the medium and so forth.

When the compound represented by formula (1) or (2) is used as a coating solution for a hydrophilic colloid (gelatin) layer as an uppermost layer of a silver halide photographic light-sensitive material, for example, the concentration of the compound represented by formula (1) or (2) that can be used in the present invention is preferably 0.003–0.5 mass % in the coating composition, or preferably 0.03–5 mass % with respect to the gelatin solid content.

[Silver Halide Photographic Light-Sensitive Material]

The silver halide photographic light-sensitive material according to the present invention may contain various other compounds, besides the compound represented by formula (1), or the compounds represented by formulas (1) and (2) in the case of using them in combination, and the compounds may be dissolved or dispersed in the medium. For example, when they are used for forming a layer constituting a photographic light-sensitive material, there can be mentioned various couplers, ultraviolet absorbers, color-mixing inhibitors, antistatic agents, scavengers, antifoggants, hardeners, dyes, fungicides and so forth. Further, as described above, the aqueous coating composition according to the present invention is preferably used for forming a hydrophilic colloid layer as an uppermost layer of a photographic light-sensitive material, and in this case, the coating composition may contain other surfactants, matting agents, lubricants, colloidal silica, gelatin plasticizers and so forth, besides the hydrophilic colloid (e.g., gelatin) and the fluorine-containing compound for use in the present invention.

The silver halide photographic light-sensitive material of the present invention, in which at least one compound represented by formula (1) or at least one compound represented by formula (2) is used, is preferably a material having sensitivity to light, laser or X-ray irradiation, and can be selected from black and white reversal films, black and white negative films, color reversal films, color negative films, films designed for digital scanning of their light-sensitive photographic components, black and white reversal paper, black and white paper, color paper, reversal color paper, paper designed to sensitize its light-sensitive photographic component by laser irradiation from a digital data base, sensitive materials designed for development by heat, and the like of these silver halide photographic light-sensitive materials, the materials sensitive to X-ray irradiation are preferred over the others.

The silver halide photographic light-sensitive material of the present invention is described below in detail.

[Silver Halide Emulsion]

First, silver halide emulsions that can be used in the present invention are described.

(1) Halide Composition

Any of silver chloride, silver chlorobromide, silver bromide, silver iodobromide and silver iodochlorobromide can be used for light-sensitive silver halide grains. From the viewpoint of rapid processing, the average iodide content in the light-sensitive silver halide grains is preferably from 0 to 0.45 mol %, more preferably from 0.05 to 0.40 mol %, and further preferably from 0.10 to 0.30 mol %. Herein, the term "average" iodide content in the light-sensitive silver halide grains refers to the average value of iodide contents determined from each individual halide compositions of the light-sensitive silver halide grains. The distribution of the halide composition in the light-sensitive silver halide grains may be uniform, or it may vary stepwise or continuously. As the light-sensitive silver halide grains, those having a core/shell structure can be used.

(2) Grain Shape

The grains of the so-called halogen conversion type as disclosed in British Patent No. 635,841 and U.S. Pat. No. 3,622,318 are also suitable as light-sensitive silver halide grains. The halogen conversion is generally carried out by adding an aqueous solution of halide having a smaller solubility product constant in relation to silver than the halide composition at the grain surface before halogen conversion. For instance, the conversion is caused by adding an aqueous solution of potassium bromide and/or potassium iodide to silver chloride or silver chlorobromide tabular grains, or by adding an aqueous solution of potassium iodide to silver bromide or silver iodobromide tabular grains. It is preferable that the concentrations of these aqueous solutions added are low. Specifically, the concentration of the solutions added is preferably 30% or less, more preferably 10% or less. It is preferable that the halide solution for conversion is added at a speed of 1 mol %/minute or less per mol of pre-conversion silver halide. Part or all of sensitizing dyes and/or silver halide-adsorbing substances may be present during the halogen conversion. In addition, instead of the aqueous halide solution for conversion, a fine particle of silver halide, such as silver bromide, silver iodobromide and silver iodide, may be added. Each size of these fine particles is generally 0.2 μm or less, preferably 0.1 μm or less, particularly preferably 0.05 μm or less. Halogen conversion methods usable in the present invention should not be construed as being limited to the aforementioned methods, but methods variously combined depending on the intended purposes can also be used.

(3) Grain Size

Methods of forming light-sensitive silver halide grains are well known in this art. For instance, these grains can be prepared using the method as disclosed in JP-A-2-68539, U.S. Pat. No. 3,700,458 or Research Disclosure, No. 17029 (June 1978).

(4) Chemical Sensitization Method

As a chemical sensitization method, the methods disclosed in JP-A-2-68539 from page 10, right upper column, line 13 to left lower column, line 16; JP-A-5-313282 and JP-A-6-110144 can be used.

More specifically, known methods of chemical sensitization of the silver halide emulsion, such as sulfur sensitization methods, selenium sensitization methods, reduction sensitization methods and gold sensitization methods, can be used in the presence of a substance which is adsorbed onto silver halides, and these methods may be used individually or in combination.

The gold sensitization methods are typical of the noble metal sensitization methods, and in this case, gold compounds, principally gold complex salts, are used. Complex salts of noble metals other than gold, for example, of platinum, palladium and iridium, may be included in the sensitizers used therein. Actual examples have been disclosed, for example, in U.S. Pat. No. 2,448,060 and British Patent No. 618,061.

As well as sulfur compounds which are contained in gelatin, a variety of other sulfur compounds, such as thiosulfate, thioureas, thiazoles and rhodanines, can be used as sulfur sensitizing agents. Actual examples have been disclosed in U.S. Pat. Nos. 1,574,944, 2,278,947, 2,410,689, 2,728,668, 3,501,313 and 3,656,955. Examples of selenium sensitizers include those described in JP-A-6-110144.

A combination of sulfur sensitization using a thiosulfate, and selenium sensitization or gold sensitization is particularly effective in the present invention. As a reduction sensitizer, stannous salts, amines, formamidine sulfinic acid and silane compounds can be used.

(5) Antifoggant and Stabilizer

Examples of antifoggants and stabilizers that can be used in the present invention include compounds described in JP-A-2-68539 from page 10, left lower column, line 17 to page 11, left upper column, line 7, and from page 3, left lower column, line 2 to page 4, left lower column.

Specific examples of such compounds include azoles (such as benzothiazolium salts, nitroimidazoles, nitrobenzimidazoles, chlorobenzimidazoles, bromobenzimidazoles, nitroindazoles, benzotriazoles, and aminotriazoles); mercapto compounds (such as mercaptotetrazoles, marcaptobenzothiazoles, mercaptobenzimidazoles, mercaptothiadiazoles, mercaptotetrazoles, mercaptopyrimidines, and mercaptotriazines); thioketo compounds, such as oxazolinethione; azaindenes (such as triazaindenes, tetraazaindenes (especially 4-hydroxy-substituted-(1,3,3a,7)-tetraazaindenes), and pentaazaindenes); and a number of compounds known as antifoggants or stabilizers, such as benzenethiosulfonic acid, benzene sulfinic acid, and benzenesulfonic acid amide.

Among these, in particular, the nitron and its derivatives disclosed in JP-A-60-76743 and JP-A-60-87322, the mercapto compounds disclosed in JP-A-60-80839, the heterocyclic compounds disclosed in JP-A-57-164735, and complex salts of a heterocyclic compound and an acid (e.g., 1-phenyl-5-mercaptotetrazoles) can be preferably used.

Further, it is possible to use purines, nucleic acids, and polymer compounds disclosed in JP-B-61-36213 ("JP-B" means examined Japanese patent publication), JP-A-59-90844 and the like. Of these compounds, in particular, azaindenes, purines and nucleic acids are preferred over the others. The addition amount of these compounds is generally from 0.5 to 5.0 mmol, and preferably 0.5 to 3.0 mmol, per mol of the silver halide.

(6) Color-Tone Improver

Examples of a color-tone improver that can be used in the present invention include the compounds described in JP-A-62-276539 from page 2, left lower column, line 7 to page 10, left lower column, line 20, and JP-A-3-94249 from page 6, left lower column, line 15 to page 11, right upper column, line 19.

Specifically, a dye having its maximum absorption wavelength of between 520 nm and 560 nm and a dye having its maximum absorption wavelength of between 570 nm and 700 nm can be contained in the silver halide photographic emulsion layer and/or other layers, so that the covering power of a silver halide photographic emulsion layer becomes at least 60, and that optical density in the unexposed areas after developing process increases by 0.03 or below by adding the dyes.

Examples of a typical emulsion capable of imparting a covering power of 60 or more to the silver halide photographic emulsion layer include tabular emulsions and fine-particle emulsions. The color-tone improving effect is especially remarkable, when the silver halide photographic emulsion used includes tabular silver halide grains having grain thickness of 0.4 μm or less, or when a mixture of a surface-light-sensitive emulsion having a high iodide content with an emulsion containing grains internally fogged by fine particles, is used.

The combination of a dye having its maximum absorption wavelength of between 520 nm and 560 nm, preferably between 530 nm and 555 nm, and a dye having its maximum absorption wavelength between 570 nm and 700 nm, preferably 580 nm and 650 nm, can be preferably used for color-tone improvement in the present invention. The term "maximum absorption wavelength" as used herein refers to the maximum absorption wavelength when a dye is in a light-sensitive material.

As the dye that can be used in the present invention, a dye having a given maximum absorption wavelength selected from the group of, for example, anthraquinone dyes, azo dyes, azomethine dyes, indoaniline dyes, oxonol dyes, carbocyanine dyes, styryl dyes and triphenylmethane dyes, can be included. Upon a consideration of influences on photographic properties including stability in development processing, light fastness, desensitization, fog, and stain, the dye selected from the group of anthraquinone dyes, azo dyes, azomethine dyes and indoaniline dyes can be suitably used. The compounds suitable as such dyes are described in JP-A-62-276539 from page 3, left upper column, line 5 to page 9, left upper column, line 9.

Such dyes can be dispersed in an emulsion layer and the other hydrophilic colloid layers (such as an intermediate layer, a protective layer, an antihalation layer and a filter layer) according to various known methods. Specifically, examples of the dispersion method are described in JP-A-62-276539 from page 9, left upper column, line 14 to page 10, left lower column, line 20.

(7) Spectral Sensitizing Dye

Examples of spectral sensitizing dyes that can be used in the present invention include those described in JP-A-2-68539 from page 4, right lower column, line 4 to page 8, right lower column.

Specific examples thereof include a cyanine dye, a merocyanine dye, a complex cyanine dye, a complex merocyanine dye, a holopolar cyanine dye, a styryl dye, a hemicyanine dye, an oxonol dye, and a hemioxonol dye.

Sensitizing dyes that can be suitably used in the present invention are described, for example, in U.S. Pat. Nos. 3,522,052, 3,617,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,613,638, 3,615,635, 3,705,809, 3,632,349, 3,677,765, 3,770,449, 3,770,440, 3,769,025, 3,745,014, 3,713,826, 3,567,458, 3,625,698, 2,526,632 and 2,503,776, JP-A-48-76525, and Belgium Patent No. 691807. It is appropriate to add the sensitizing dyes in an amount ranging from 0.5 mmol to less than 4 mmol, preferably from 0.5 mmol to less than 1.5 mmol, per mol of the silver halide.

Specific examples of the sensitizing dyes include II-1 to II-47 illustrated in JP-A-2-68539, pages 5 to 8.

(8) Antistatic Agent

In the present invention, the surfactants described in JP-A-2-68539 from page 11, left upper column, line 14 to page 12, left upper column, line 9 can be used as coating aids, antistatic agents or static controlling agents.

Examples of surfactants used for such a purpose include nonionic surface active agents, such as saponin (steroid type), alkyleneoxide derivatives (e.g., polyethylene glycol, polyethylene glycol/polypropylene glycol condensates, polyethylene glycol alkyl ethers or polyethylene glycol alkyl aryl ethers, and polyethylene oxide compounds of silicon), alkyl esters of sugars, and so on; anionic surfactants, such as alkylsulfonates, alkylbenzenesulfonates, alkylnaphthalenesulfonates, alkylsulfates, N-acyl-N-alkyltaurines, sulfosuccinic acid esters, sulfoalkylpolyoxyethylene alkyl phenyl ethers, and so on; amphoteric surfactants, such as alkylbetaines, alkylsulfobetaines, and so on; and cationic surfactants, such as aliphatic or aromatic quaternary ammonium salts, pyridinium salts, imidazolium salts, and so on.

Among these, especially preferred are saponin; anionic surfactants such as sodium dodecylbenzenesulfonate, sodium di-2-ethylhexyl-α-sulfosuccinate, sodium p-octylphenoxyethoxyethanesulfonate, sodium dodecyl sulfate, sodium triisopropylnaphthalenesulfonate, and sodium N-methyl-oleoyltaurin; cationic surfactants such as dodecyltrimethylammonium chloride, N-oleoyl-N',N',N'-trimethylammonio-diaminopropane bromide, and dodecylpyridinium chloride; betaines such as N-dodecyl-N,N-dimethylcarboxybetaine, and N-oleyl-N,N-dimethylsulfobutylbetaine; and nonionic surfactants such as poly(mean polymerization degree, n=10)oxyethylene cetyl ether, poly(n=25)oxyethylene p-nonylphenyl ether, and bis (1-poly(n=15)oxyethylene-oxy-2,4-di-t-pentylphenyl) ethane.

As the antistatic agent, nonionic surfactants as described in JP-A-60-80848, JP-A-61-112144, JP-A-62-172343, and JP-A-62-173459; alkali metal nitrates; and conductive tin oxide, zinc oxide, or vanadium pentoxide, or antimony-doped complex oxides thereof, can be preferably used.

(9) Matting Agent, Lubricant and Plasticizer

As a matting agent, lubricant and plasticizer that can be used in the present invention, those described in JP-A-2-68539 from page 12, left upper column, line 10 to right upper column, line 10, and from page 14, left lower column, line 10 to right lower column, line 1, can be included.

Specific examples of the matting agent include a fine particle of an organic compound, such as homopolymers (e.g., polymethylmethacrylate), copolymers of methylmethacrylate and methacrylic acid, and starch; and a fine particle of an inorganic compound, such as silica, titanium dioxide, strontium sulfate, barium sulfate, and strontium barium sulfate, as described in U.S. Pat. Nos. 2,992,101, 2,701,245, 4,142,894 and 4,396,706. The particle size thereof is preferably 1.0 to 10 μm and particularly preferably 2 to 5 μm.

The surface layer of the photographic light-sensitive material of the present invention may contain, as a lubricant, silicone compounds described in U.S. Pat. Nos. 3,489,576 and 4,047,958, and so on; colloidal silica described in JP-B-56-23139, paraffin wax, higher fatty acid esters, starch derivatives and so on.

The hydrophilic colloid layers of the silver halide photographic light-sensitive material of the present invention can contain, as a plasticizer, polyols such as trimethylolpropane, pentanediol, butanediol, ethylene glycol and glycerin. In addition, the emulsion layers of the silver halide photographic light-sensitive material of the present invention may contain a polymer or an emulsion for the purpose of improving pressure resistance.

For example, a method in which a heterocyclic compound is used has been disclosed in British Patent No. 738,681, a method in which an alkyl phthalate is used has been disclosed in British Patent No. 738,637, a method in which an alkyl ester is used has been disclosed in British Patent No. 738,639, a method in which a poly-hydric alcohol is used has been disclosed in U.S. Pat. No. 2,960,404, a method in which carboxyalkylcellulose is used has been disclosed in U.S. Pat. No. 3,121,060, a method in which paraffin and a carboxylic acid salt are used has been disclosed in JP-A-49-5017 and a method in which an alkyl acrylate and an organic acid are used has been disclosed in JP-B-53-28086. These methods may be applied to the present invention.

(10) Hydrophilic Colloid

As a binder or a protective colloid that can be used in an emulsion layer, an intermediate layer and a surface protective layer of the silver halide photographic light-sensitive material of the present invention, it is advantageous to use gelatin. However, other hydrophilic colloids can also be used.

Examples of the hydrophilic colloid that can be used in the present invention include those described in JP-A-2-68539 from page 12, right upper column, line 11 to left lower column, line 16.

Use can be made of, for example, a gelatin derivative, a graft polymer of gelatin with another polymer, a protein such as albumin and casein; a cellulose derivative, such as hydroxyethyl cellulose, carboxymethyl cellulose, and cellulose sulfates; sodium alginate, a saccharide derivative, such as a dextran, and starch derivative; and many synthetic hydrophilic polymers, including homopolymers and copolymers, such as a polyvinyl alcohol, a polyvinyl alcohol partial acetal, a poly-N-vinylpyrrolidone, a polyacrylic acid, a polymethacrylic acid, a polyacrylamide, a polyvinylimidazole, and a polyvinylpyrazole As the gelatin, in addition to lime-processed gelatin, acid-processed gelatin and enzyme-processed gelatin can be used. Further, a hydrolyzate or enzymolyzate of gelatin can also be used.

Among them, polyacrylamide and dextran having an average molecular weight of 100,000 or less are used preferably in combination with gelatin. The methods described in JP-A-63-68887 and JP-A-63-149641 are also effective in the present invention.

(11) Hardener

An inorganic or organic hardener may be added to a photographic emulsion and light-insensitive colloid that can be used in the present invention. As the hardener that can be used in the present invention, those described in JP-A-68539 from page 12, lower left column, line 17 to page 13, upper right column, line 6, can be mentioned.

For example, chromium salts (for example chrome alum, chromium acetate), aldehydes (for example, formaldehyde, glyoxal, glutaraldehyde), N-methylol compounds (for example, dimethylolurea, methyloldimethylhydantoin), dioxane derivatives (for example, 2,3-dihydroxydioxane), active vinyl compounds (for example, 1,3,5-triacryloylhexahydro-s-triazine, bis(vinylsulfonyl)methyl ether, N,N'-methylenebis-[β-(vinylsulfonyl)propionamide]), active halogen compounds (for example, 2,4-dichloro-6-hydroxy-s-triazine), mucohalogen acids (for example, mucochloric acid, mucophenoxychloric acid), isooxazoles, dialdehyde starch, and 2-chloro-6-hydroxytriazinylized gelatin can be used either individually or in combinations. From among these, the active vinyl compounds disclosed in JP-A-53-41221, JP-A-53-57257, JP-A-59-162546 and JP-A-60-80846, and the active halogen compounds as disclosed in U.S. Pat. No. 3,325,287 are preferred.

Polymeric film hardening agents can also be used effectively as film hardening agents in the present invention. Examples of the polymeric film hardening agents which can be used in the present invention include dialdehyde starch, polyacrolein, the polymers which have aldehyde groups, such as the acrolein copolymers, disclosed in U.S. Pat. No. 3,396,029, the polymers which have an epoxy group disclosed in U.S. Pat. No. 3,623,878, the polymers which have dichlorotriazine groups as disclosed, for example, in U.S. Pat. No. 3,362,827 and Research Disclosure 17333 (1978), the polymers which have active ester groups disclosed in JP-A-56-66841, the polymers which have active vinyl groups or precursors thereof as disclosed, for example, in JP-A-56-142524, U.S. Pat. No. 4,161,407, JP-A-54-65033 and Research Disclosure, 16725 (1978). The polymers which have active vinyl groups or precursors thereof are preferred. Among these, the polymers in which the active vinyl groups or precursors thereof are bonded to the main polymer chain with long spacer groups as disclosed in JP-A-56-142524 are particularly preferred.

The hydrophilic colloid layers of the silver halide photographic light-sensitive material of the present invention are preferably hardened with these hardeners so that the swelling rate of the material in water becomes 300% or lower, particularly 230% or lower.

(12) Support

Examples of a support that can be used in the invention include those described in JP-A-2-68539, page 13, right upper column, lines 7 to 20. Specifically, it is preferable to use polyethylene terephthalate film or cellulose triacetate film as a support.

For enhancing adhesion of the support to the hydrophilic colloid layer, it is preferable that the support surface is subjected to corona-discharge treatment, glow-discharge treatment or ultraviolet-irradiation treatment. According to another method, an undercoat layer made up of styrene-butadiene-series latex or vinylidene chloride-series latex may be provided on the support surface, and a gelatin layer may further be coated thereon.

According to still another method, an undercoat layer may be formed on the support surface using an organic solvent containing a polyethylene-swelling agent and gelatin. Further, the adhesion of these undercoat layers to the hydrophilic colloid layer can be further heightened by a surface treatment.

(13) Method of Cutting Crossover

It is a well-known fact in the art that crossover light remarkably lowers sharpness. As to a method for reducing the crossover light in the photographic light-sensitive material to be 12% or less, a method of absorbing light of wavelength corresponding with the wavelength of light emission from an X-ray fluorescent screen by using a sensitizing dye or the other dyes, is disclosed in, for example, U.S. Pat. No. 4,130,429 and JP-A-61-116354.

In addition, U.S. Pat. No. 4,803,150 discloses a method of reducing the crossover light to 10% or less by a dye present in the form of fine-crystal dispersion between a support and an emulsion layer. Further, a method of fixing an anionic dye to a specified layer by use of a cationic polymer latex is disclosed in JP-A-63-305345, and a method of using a dye-fixing layer as an undercoat layer of a support is disclosed in JP-A-1-166031. Although any of these methods can be applied to the light-sensitive material of the present invention, it is preferable that a layer to be colored by the dye is an undercoat layer, and that the dye is fixed according to the method described in JP-A-1-166031. And, it is particularly preferable to fix the dye to the undercoat layer in the fine-crystal dispersion form as described in U.S. Pat. No. 4,803,150. In the present invention, it is possible to use these methods in combination as appropriate.

Examples of dyes which can be preferably used in the present invention include the dyes described in JP-A-2-264944 from page 4, left lower column to page 9, right upper column.

In addition, as a mordant layer, those described in JP-A-2-264944 from page 9, right lower column to page 14, right upper column, can be used.

(14) Polyhydroxybenzenes

Examples of polyhydroxybenzenes that can be used in the present invention include those described in JP-A-3-39948 from page 11, left upper column to page 12, left lower column, and EP 452772.

Specifically, the compounds represented by formula (III) in JP-A-3-39948, page 11, left upper column, and their exemplified compounds (III)-1 to (III)-25 illustrated in the same document as cited above, from page 11, left lower column to page 12, left lower column, can be used.

The addition amount of the polyhydroxybenzene compound is generally smaller than $5\times10^{-1}$ mol, preferably from $1\times10^{-1}$ to $5\times10^{-3}$ mol, per mol of the silver halide.

The silver halide photographic light-sensitive material of the present invention comprises, on a support, a silver halide emulsion layer containing light-sensitive silver halide grains (light-sensitive layer), and at least one non-light-sensitive hydrophilic colloid layer, such as an intermediate layer, a surface protective layer, a backing layer, a back protective layer, an anti-halation layer and a filter layer. The method of sensitizing the emulsion and other various additives that can be used in the present invention is not particularly limited, and those described in JP-A-2-68539 is preferably used in the present invention.

(15) Surface Protective Layer and Back Protective Layer

It is preferable that the silver halide photographic light-sensitive material of the present invention has a surface protective layer and a back protective layer. The surface protective layer and the back protective layer contain various chemicals with a hydrophilic colloid, such as gelatin, functioning as a binder. When such protective layers each contain gelatin as a main component, addition of an antiseptic thereto is required. Further, those protective layers preferably contain, if necessary, a matting agent, a lubricant, a plasticizer, an antistatic agent, a surfactant, a hardener, a viscosity-enhancer, a dye, and a conductive substance.

(16) Development Processing Method

As a development processing method of the silver halide photographic light-sensitive material of the present invention, the methods described in JP-A-2-103037 from page 16, right upper column, line 7 to page 19, left lower column, line 15, JP-A-2-115837 from page 3, right lower column, line 5 to page 6, left upper column, line 10, and JP-A-2000-112078 from page 34, left column, line 42 to page 35, left column, line 2, can be adopted. In the case of a heat-development light-sensitive material, the methods and the like described in JP-A-2001-255617, paragraph No. 0137, can be adopted. In this case, it is preferable that the methods described in JP-A-2001-255617, paragraph No. 0138 are adopted to the heat-development light-sensitive materials described in JP-A-2001-255617, paragraph No. 0139.

According to the present invention, it is possible to provide a silver halide photographic light-sensitive material that is reduced in environmental load, and that is excellent in static resistance and antistatic power, by use of a novel fluorine-containing surfactant, especially nonionic surfactant. Further, according to the present invention, it is possible to provide an aqueous coating composition that can be used, for example, for the silver halide photographic light-sensitive material.

The photographic light-sensitive material of the present invention is low in surface resistance and excellent in anti-static (static-preventing) property and static resistance. That is, the present invention can provide an aqueous coating composition, and a silver halide photographic light-sensitive material to which anti-static property is imparted by not containing any perfluorooctanesulfonic acid derivatives but using a novel fluorine-containing surfactant.

The present invention will be described in more detail based on the following examples, but the invention is not intended to be limited thereto.

EXAMPLES

Example 1

<Silver Halide Photographic Light-Sensitive Material>

1. Preparation of Support with Undercoat Layer

1) Preparation of Dye D-1 for Undercoat Layer

The following dye was treated with a ball mill by the method described in JP-A-63-197943.

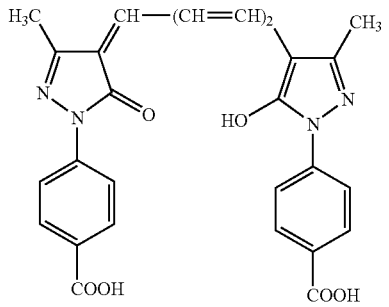

In a 2-liter ball mill, 434 ml of water and 791 ml of a 6.7 mass % aqueous solution of surfactant Triton X-200 (TX-200, trade name), were placed, and 20 g of the dye was added to the solution. Then, 400 ml of zirconium oxide (ZrO) beads (2 mm in diameter) was added, and the contents were pulverized for 4 days. Thereafter, 160 g of 12.5 mass % gelatin was added. After defoaming, the ZrO beads were removed by filtration. The observation of the resulting dye dispersion showed that the grain diameter of the pulverized dye was in the wide range of 0.05 to 1.15 μm and the mean grain diameter was 0.37 μm. Further, dye grains having a diameter of 0.9 μm or mote were removed by centrifugal separation. In this manner, Dye Dispersion D-1 was obtained.

2) Preparation of Support

A biaxially oriented polyethylene terephthalate film of 183 μm in thickness was subjected to a corona discharge treatment. A first undercoating solution having the following composition was coated on the surface of the film in such an amount as to give a coating amount of 4.9 ml/m$^2$. The coating was carried out by means of a wire bar coater. The coated film was dried at 175° C. for one minute. Similarly, a first undercoat layer was coated on the opposite side of the film to the above coated side. The polyethylene terephthalate film used contained 0.04 mass % of the following dye.

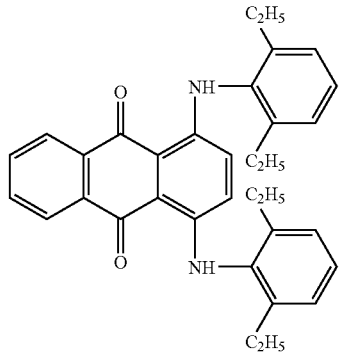

Composition of First Undercoating Solution

The amount of the coating solution for one side of the support was adjusted to 4.9 ml/m$^2$, and the amount of each component per 1 m$^2$ of one side of the support was as shown below.

| | |
|---|---|
| Butadiene/styrene copolymer latex (in terms of solid content) *The latex solution contained 0.4 mass % (based on the solid in the latex) of the following surfactant as an emulsifying dispersant. | 0.31 g |
| Sodium 2,4-dichloro-6-hydroxy-s-triazine | 8 mg |

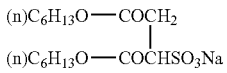

On the above-described first undercoat layers provided on both surfaces of the support, a second undercoat layer having the following composition was coated on each surface by a wire bar coater method to give the coated amount shown below, and then dried, at 150° C.

| Composition of second undercoating layer- (coating amount for one side per m$^2$) | |
|---|---|
| Gelatin | 81 mg |
| $C_{12}H_{25}O(CH_2CH_2O)_{10}H$ | 3.8 mg |
| Antiseptic D | 0.28 mg |
| Polymethyl methacrylate matting agent with an average particle diameter of 2.5 μm | 2.3 mg |
| Polymer latex of ethyl acrylate/acrylic acid (= 95/5) *3 mass % of A-9 was contained based on the polymeric solid content. | 21 mg |
| Dye dispersion D-1 | 8.2 mg |
| Acetic acid | 0.6 mg |

Antiseptic D

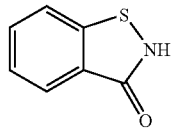

-continued

A-9

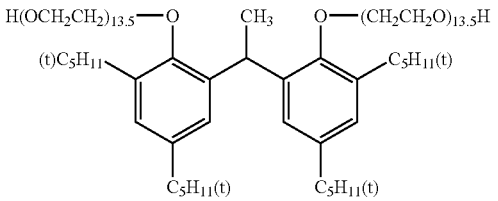

2. Preparation of Coating Solutions

1) Preparation of Silver Halide Emulsion T-1

To one liter of water, there were added 6 g of potassium bromide and 7 g of gelatin. To the resulting solution kept at 55° C., with stirring, there were added 37 ml of an aqueous solution of silver nitrate (4.00 g of silver nitrate) and 38 ml of an aqueous solution containing 5.9 g of potassium bromide over a period of 37 seconds by means of the double jet process. After 18.6 g of gelatin was added thereto, the temperature of the mixture was raised to 70° C., and 89 ml of an aqueous solution of silver nitrate (9.8 g of silver nitrate) was added thereto over a period of 22 minutes. Subsequently, 7 ml of a 25% aqueous solution of ammonia was added thereto. Physical ripening was conducted at that temperature for 10 minutes, and 6.5 ml of 100% acetic acid solution was added thereto. Subsequently, an aqueous solution containing 153 g of silver nitrate and an aqueous solution of potassium bromide were added thereto, over a period of 35 minutes, by means of the controlled double jet process, while keeping a pAg of 8.5. The pBr was then adjusted to 2.8 by using an aqueous solution of silver nitrate, and 15 ml of a solution of 2 mol/L potassium thiocyanate was added thereto. Physical ripening was conducted at that temperature for 5 minutes, and the temperature of the emulsion was lowered to 35° C. Thus, there were obtained monodisperse pure silver bromide tabular grains having an average projected area diameter of 1.10 μm, a thickness of 0.165 μm, and a coefficient of variation in the grain diameter of 18.5%.

Then, soluble salts were removed by a precipitation method. The temperature of the emulsion was raised to 40° C., and 30 g of gelatin, 2.35 g of phenoxyethanol, and 0.8 g of sodium polystyrenesulfonate as a viscosity-enhancing agent, were added thereto. The pH and the pAg of the emulsion were adjusted to 5.90 and 8.25, respectively, by using sodium hydroxide and a silver nitrate solution. The emulsion was chemically sensitized, while keeping at a temperature of 56° C. with stirring. In this time, 0.05 mol % of AgI fine-particle was added per mol of the monodisperse pure silver bromide tabular grain before and during the chemical sensitization, respectively. First, 0.043 mg of thiourea dioxide was added, and reduction sensitization was carried out by keeping the emulsion as such for 22 minutes. Subsequently, 20 mg of 4-hydroxy-6-methyl-1,3,3a,7-tetrazaindene and 400 mg of the sensitizing dye A were added. Further, 0.83 g of an aqueous solution of calcium chloride was added. Subsequently, 1.5 mg of sodium thiosulfate as a sensitizing agent, 2.2 mg of the following selenium sensitizing agent, 2.6 mg of chloroauric acid, and 90 mg of potassium thiocyanate were added. After 40 minutes, the emulsion was cooled to 35° C. Thus, tabular silver halide Emulsion T-1 was prepared. The average iodide content in the obtained silver halide grains of Emulsion T-1 was 0.1 mol %.

Sensitizing dye A

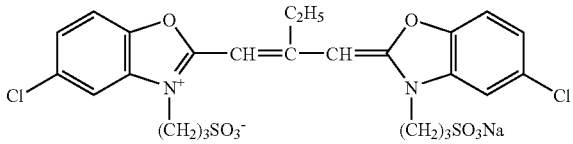

Selenium sensitizing agent

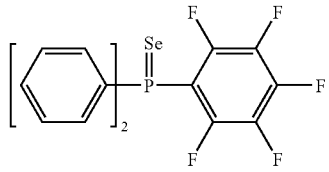

2) Preparation of Silver Halide Emulsion T-2

A silver halide emulsion T-2 was prepared in the same manner as the silver halide Emulsion T-1, except that the amount of AgI fine-particle added before and during the chemical sensitization, respectively, was changed to 0.5 mole %.

The average iodide content in the silver halide grains of the silver halide emulsion T-2 was 1.0 mol %.

3) Preparation of Coating Samples

-Preparation of Coating Solution T-1 for Emulsion Layer-

An emulsion coating solution T-1 was prepared by adding the following compounds so as to have the following coating amounts.

| | |
|---|---|
| Emulsion T-1 (in terms of silver) | 1.09 g/m$^2$ |
| Dextran (average molecular weight: 39,000) | 0.21 g/m$^2$ |
| Sodium polystyrenesulfonate (average molecular weight: 600,000) | 19 mg/m$^2$ |
| Hardener (1,2-bis(vinylsulfonylacetamido)ethane) | 26 mg/m$^2$ |
| A-1 | 4.1 mg/m$^2$ |
| A-2 | 0.2 mg/m$^2$ |
| A-3 | 1.1 mg/m$^2$ |
| A-5 | 0.1 g/m$^2$ |
| $C_{16}H_{33}(CH_2CH_2O)_{10}H$ | 0.02 g/m$^2$ |

-Preparation of Coating Solution T-2 for Emulsion Layer-

An emulsion coating solution T-2 was prepared by adding the following compounds so as to have the following coating amounts.

| | |
|---|---|
| Emulsion T-2 (in terms of silver) | 0.66 g/m$^2$ |
| Dextran (average molecular weight: 39,000) | 0.13 g/m$^2$ |
| Sodium polystyrenesulfonate (average molecular weight: 600,000) | 11 mg/m$^2$ |
| Hardener (1,2-bis(vinylsulfonylacetamido)ethane) | 27 mg/m$^2$ |
| A-1 | 1.2 mg/m$^2$ |
| A-2 | 0.1 mg/m$^2$ |
| A-3 | 0.6 mg/m$^2$ |
| A-5 | 0.06 g/m$^2$ |
| A-6 | 0.34 g/m$^2$ |

-continued

A-1

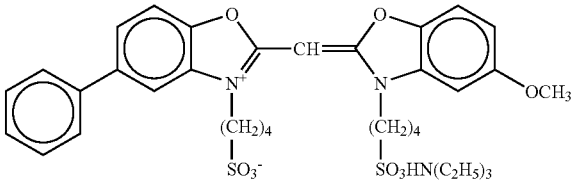

A-2

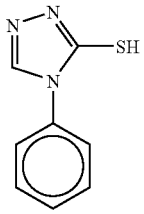

A-3

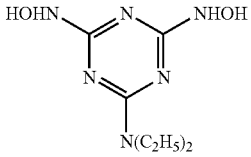

A-5

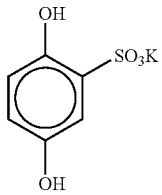

A-6

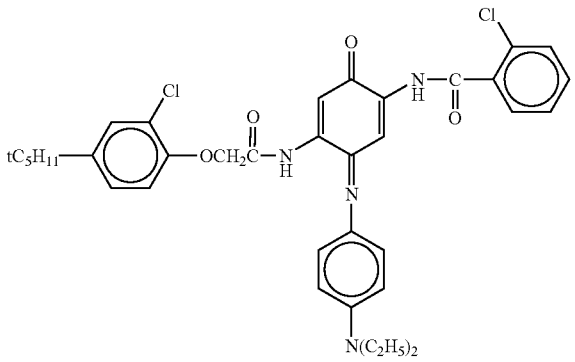

-Preparation of Coating Solutions for Surface Protective Layers-

Coating solutions for surface protective layers using surfactants defined in the present invention and surfactants for comparison were prepared and coated in the following manner.

| Content in coating solution | Coating Amount |
|---|---|
| Gelatin | 0.966 g/m$^2$ |
| Sodium polyacrylate (average molecular weight: 400,000) | 0.023 g/m$^2$ |
| 4-Hydroxymethyl-1,3,3a,7-tetrazaindene | 0.015 g/m$^2$ |
| Polymethyl methacrylate (average particle diameter: 3.7 μm) | 0.087 g/m$^2$ |
| Proxel (adjusted to pH 7.4 with NaOH) | 0.0005 g/m$^2$ |
| Fluorine-containing compounds | (Shown in Table 1) |
| $C_{14}H_{29}$—O—$(CH_2CH_2O)_n$—$(CH_2)_4$—$SO_3Na$ (n = 2 on average) | 0.0179 g/m$^2$ |

In addition, the following compounds were used in the coating solutions.

| | |
|---|---|
| $C_{16}H_{33}O(C_2H_4O)_{10}H$ | 0.045 g/m$^2$ |
| $C_{17}H_{35}CON(CH_3)CH_2SO_3Na$ | 0.0065 g/m$^2$ |
| 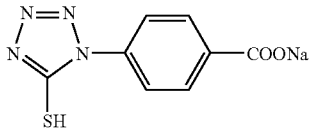 | 1.7 mg/m$^2$ |

3. Coating

On both sides of the support provided with the undercoat layers described above, the coating solutions T-1 and T-2 for emulsion layer, and the coating solution for surface protective layer, were coated using a simultaneous extrusion method, thereby forming emulsion layers and a surface protective layer. The coated silver amount on one side was adjusted to 1.75 g/m$^2$.

4. Evaluation of Samples

In accordance with the Wilhelmy method, the outermost protective layer of each sample was examined for surface resistance (under humidity adjusted to 25% RH at 25° C.), immediately after the sample preparation, and after a two-month lapse from the sample preparation, respectively. Results obtained are shown in Table 1.

TABLE 1

| | Kind and amount of used anionic fluorine-containing compound (mg/m$^2$) | | Kind and amount of used nonionic fluorine-containing compound (mg/m$^2$) | | Surface resistance immediately after sample preparation (log[Ω/m$^2$] | Surface resistance after 2-month lapse from sample preparation (log[Ω/m$^2$] |
|---|---|---|---|---|---|---|
| Comparative example 1 | C-2 | 1.44 | C-1 | 3.18 | 12.5 | 12.6 |
| Comparative example 2 | FS-1 | 0.77 | C-1 | 3.18 | 12.7 | 13.0 |
| This invention 1 | FS-1 | 0.77 | FNS-1 | 3.18 | 12.4 | 12.5 |
| This invention 2 | FS-1 | 0.77 | FNS-1 | 4.20 | 12.4 | 12.4 |
| This invention 3 | FS-7 | 0.77 | FNS-2 | 3.18 | 12.4 | 12.5 |

TABLE 1-continued

| | Kind and amount of used anionic fluorine-containing compound ($mg/m^2$) | | Kind and amount of used nonionic fluorine-containing compound ($mg/m^2$) | | Surface resistance immediately after sample preparation ($\log[\Omega/m^2]$ | Surface resistance after 2-month lapse from sample preparation ($\log[\Omega/m^2]$ |
|---|---|---|---|---|---|---|
| This invention 4 | FS-1 | 0.77 | FNS-3 | 3.18 | 12.5 | 12.5 |
| This invention 5 | FS-7 | 0.77 | FNS-4 | 3.18 | 12.6 | 12.6 |

Compound C-1 (For comparison): $C_8F_{17}SO_2N(C_3H_7)(CH_2CH_2O)_4(CH_2)_4SO_3Na$
Compound C-2 (For comparison): $C_8F_{17}SO_2N(C_3H_7)(CH_2CH_2O)_{16}H$ As can be seen in Table 1, the compounds (surfactants) represented by formula (1) or (2) reduced the surface resistance values, to the level equivalent to or lower than that attained by the conventionally used fluorine-containing surfactants derived from perfluorooctancesulfonic acid. Additionally, the light-sensitive materials containing compounds defined in the present invention had excellent aging characteristics.

5. Static Test

A screen Hi-SCREEN B-2 (trade name, manufactured by Fuji Photo Film Co., Ltd.) was applied to the inside of a cassette Fuji EC CASSETTEN (trade name, manufactured by Fuji Photo Film Co., Ltd.), and the screen was rubbed with a textile under a condition of 25° C.-25% RH. And, the static voltage of the screen surface was adjusted to the 3- to 4-kV range, while measuring by use a static potential meter M2 (trade name, manufactured by SHISHIDO ELECTROSTATIC, LTD.), by coating the screen surface with Fuji AS Cleaner (trade name, manufactured by Fuji Photo Film Co., Ltd.) for X-ray intensifying screen use, and by defilming with acetone and chloroform. The thus-treated cassette was loaded with each of the samples of the present invention and those for comparison, and allowed to stand for 30 minutes in a darkroom conditioned at 25° C. and 25% RH. Then, each sample was taken out of the cassette and was subjected to development processing with an automatic processor (CEPROS-M2 (trade name) manufactured by Fuji Photo Film Co., Ltd.). Therein, development was carried out for 25 seconds at 34° C., using a developer CED-1 (trade name, manufactured by Fuji Photo Film Co., Ltd.); the total processing time was 90 seconds; the fixing solution used was CEF-1 (trade name, manufactured by Fuji Photo Film Co., Ltd.); and tap water was used for washing.

The thus-processed samples were examined for static-mark occurrence, immediately after the sample preparation, and after 2-month lapse from the sample preparation. Evaluation was made by grading them by the extent of static-mark occurrence in accordance with the criterions described below.

| Grade | Criterion of Evaluation |
|---|---|
| 1 | Occurrence of any static mark was not observed |
| 2 | Occurrence of a few static marks were observed |
| 3 | Occurrence of a considerable number of static marks were observed |

TABLE 2

| | Performance immediately after sample preparation | Performance after 2-month lapse from sample preparation |
|---|---|---|
| Comparative example 1 | 2 | 2 |
| Comparative example 2 | 2 | 3 |
| This invention 1 | 1 | 1 |
| This invention 2 | 1 | 1 |
| This invention 3 | 1 | 1 |
| This invention 4 | 1 | 1 |
| This invention 5 | 1 | 1 |

As can be seen in Table 1 and Table 2, by using the compounds defined in the present invention, it is possible to provide a silver halide photographic light-sensitive material that is low in the surface resistance, and further, stable in static property and excellent in static resistance, even after a lapse of time, as well as in a fresh state.

Having described our invention as related to the present embodiments, it is our intention that the invention not be limited by any of the details of the description, unless otherwise specified, but rather be construed broadly within its spirit and scope as set out in the accompanying claims.

What is claimed is:

1. A silver halide photographic light-sensitive material, comprising at least one compound represented by formula (1):

Formula (1)

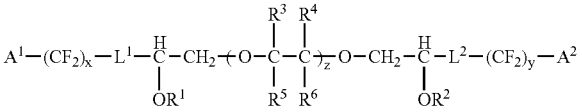

wherein, in formula (1), $A^1$ and $A^2$ each independently represent a hydrogen atom or a fluorine atom, x and y each independently represent an integer of from 1 to 6, $L^1$ and $L^2$ each independently represent $—CH_2—$ or $—CH_2OCH_2—$, z represents a number of from 1 to 60, $R^1$ and $R^2$ each independently represent a hydrogen atom or a substituent, $R^3$, $R^4$, $R^5$ and $R^6$ each independently represent a hydrogen atom, a methyl group or a hydroxymethyl group, and when both $A^1$ and $A^2$ are a fluorine atom and each of $L^1$ and $L^2$ is $—CH_2—$, $R^1$ and $R^2$ each represent a hydrogen atom.

2. The silver halide photographic light-sensitive material according to claim 1, wherein the compound represented by formula (1) is a compound represented by formula (1-B):

Formula (1 - B)

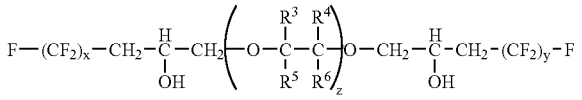

wherein, in formula (1-B), x, y, z, $R^3$, $R^4$, $R^5$ and $R^6$ have the same meanings as those in formula (1), respectively.

3. The silver halide photographic light-sensitive material according to claim 1, comprising at least one of the compound represented by formula (1) and at least one compound represented by formula (2):

Formula (2)

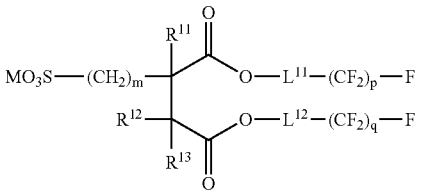

wherein, in formula (2), $R^{11}$, $R^{12}$ and Reach independently represent a hydrogen atom or a substituent; p and q each independently represent an integer of from 4 to 8; $L^{11}$ and $L^{12}$ each independently represent a substituted or unsubstituted alkylene group, a substituted or unsubstituted alkyleneoxy group, or a divalent linking group formed by combining these groups; m represents 0 or 1; and M represents a cation.

4. The silver halide photographic light-sensitive material according to claim 3, wherein the compound represented by formula (2) is a compound represented by formula (2-A):

Formula (2-A)

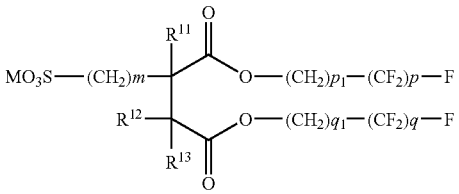

wherein, in formula (2-A), $R^{11}$, $R^{12}$, $R^{13}$, p, q, m and M have the same meanings as those in formula (2), respectively; and p1 and q1 each independently represent an integer of from 1 to 6.

5. The silver halide photographic light-sensitive material according to claim 3, wherein the compound represented by formula (2) is a compound represented by formula (2-B):

Formula ( 2 - B )

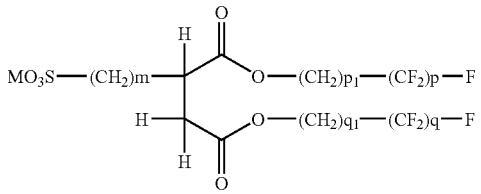

wherein, in formula (2-B), p, q, m and M have the same meanings as those in formula (2), respectively; and p1 and q1 each independently represent an integer of from 1 to 6.

6. The silver halide photographic light-sensitive material according to claim 3, wherein the compound represented by formula (2) is a compound represented by formula (2) is a compound represented by formula (2-C):

Formula (2-C)

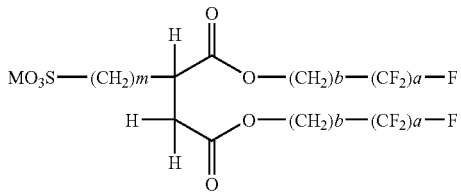

wherein, in formula (2-C), a represents an integer of from 4 to 6; b represents 2 or 3; m represents 0 or 1; and M has the same meaning as that in formula (2).

7. The silver halide photographic light-sensitive material according to claim 3, comprising at least one layer including a light-sensitive silver halide emulsion layer on a support, wherein a non-light-sensitive hydrophilic colloid layer is further included as an outermost layer, and wherein the outermost layer contains at least one of the compound represented by formula (1) and at least one of the compound represented by formula (2).

8. A silver halide photographic light-sensitive material, comprising at least one compound represented by formula (1):

Formula (1)

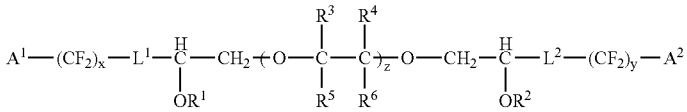

wherein, in formula (1), $A^1$ and $A^2$ each independently represent a hydrogen atom or a fluorine atom, x and y each independently represent an integer of from 1 to 6, $L^1$ and $L^2$ each independently represent —$CH_2$— or —$CH_2OCH_2$—, z represents a number of from 1 to 60, $R^1$ and $R^2$ each represent a hydrogen atom, and $R^3$, $R^4$, $R^5$ and $R^6$ each independently represent a hydrogen atom, a methyl group or a hydroxymethyl group.

9. The silver halide photographic light-sensitive material according to claim 8, wherein each of $L^1$ and $L^2$ is —$CH_2$—.

10. The silver halide photographic light-sensitive material according to claim 8, comprising at least one of the compound represented by formula (1) and at least one compound represented by formula (2):

Formula (2)

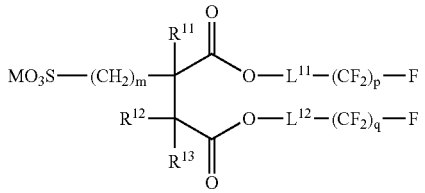

wherein in formula (2), $R^{11}$, $R^{12}$ and $R^{13}$ each independently represent a hydrogen atom or a substituent; p and q each independently represent an integer of from 4 to 8; $L^{11}$ and $L^{12}$ each independently represent a substituted or unsubstituted alkylene group, a substituted or unsubstituted alkyleneoxy group, or a divalent linking group formed by combining these groups; m represents 0 or 1; and M represents a cation.

* * * * *